US010204757B2

(12) United States Patent
Pineda et al.

(10) Patent No.: US 10,204,757 B2
(45) Date of Patent: Feb. 12, 2019

(54) ELECTRICAL CIRCUIT PROTECTION DEVICE WITH HIGH RESISTIVE BYPASS MATERIAL

(71) Applicant: Littelfuse, Inc., Chicago, IL (US)

(72) Inventors: Martin Pineda, Fremont, CA (US); Kedar Bhatawadekar, Santa Clara, CA (US); Dong Yu, Fremont, CA (US)

(73) Assignee: LITTELFUSE, INC., Chicago, IL (US)

( * ) Notice: Subject to any disclaimer, the term of this patent is extended or adjusted under 35 U.S.C. 154(b) by 0 days.

(21) Appl. No.: 15/625,191

(22) Filed: Jun. 16, 2017

(65) Prior Publication Data

US 2018/0366293 A1 Dec. 20, 2018

(51) Int. Cl.
*H01H 85/02* (2006.01)
*H01H 85/055* (2006.01)
(Continued)

(52) U.S. Cl.
CPC ..... *H01H 85/055* (2013.01); *H01H 85/0241* (2013.01); *H01H 85/048* (2013.01);
(Continued)

(58) Field of Classification Search
CPC ..... H01H 85/055; H01H 85/0241; H01H 85/048; H01H 85/143; H01H 85/165; H01H 85/20; H01H 2239/01
(Continued)

(56) References Cited

U.S. PATENT DOCUMENTS 2,673,911 A * 3/1954 Driescher ..... H01H 85/055 337/230
3,080,463 A * 3/1963 Kozacka ..... H01H 85/0456 337/158
(Continued)

FOREIGN PATENT DOCUMENTS

CH 271235 A * 10/1950 ..... H01H 85/055
DE 842222 C * 6/1952 ..... H01H 85/0241
(Continued)

OTHER PUBLICATIONS

International Search Report and Written Opinion for the International Patent Application No. PCT/US2018/037794, dated Sep. 17, 2018.

*Primary Examiner* — Anatoly Vortman

(57) ABSTRACT

A fuse suitable for arc quenching is disclosed. The fuse incorporates a high-resistive material or element placed in parallel relationship with the fusible element to mitigate, minimize and/or prevent arcing during an overcurrent condition. By incorporating a high-resistive material or element in parallel with a fusible element an alternate or second path for current flow during an overcurrent condition is provided. As such, during normal operating conditions, current travels through the fusible element. However, during an overcurrent condition, the resistance through the fusible element increases. Once the resistance through the fusible element is greater than the resistance through the high-resistive material or element, the current will bypass the fusible element
(Continued)

and travel through the high-resistive material or element. In this manner, arcing through the fusible element during the overcurrent condition can be prevented or minimized.

8 Claims, 6 Drawing Sheets

(51) Int. Cl.
*H01H 85/048* (2006.01)
*H01H 85/165* (2006.01)
*H01H 85/143* (2006.01)
*H01H 85/20* (2006.01)

(52) U.S. Cl.
CPC ..... *H01H 85/143* (2013.01); *H01H 85/165* (2013.01); *H01H 85/20* (2013.01); *H01H 2239/01* (2013.01)

(58) Field of Classification Search
USPC ..... 337/297
See application file for complete search history.

(56) References Cited

U.S. PATENT DOCUMENTS

| | | | | |
|---|---|---|---|---|
| 4,479,105 | A * | 10/1984 | Banes | H01H 39/006 218/95 |
| 9,190,833 | B2 * | 11/2015 | Colby | H01C 7/02 |
| 2006/0022300 | A1 | 2/2006 | Wu et al. | |
| 2006/0214259 | A1 | 9/2006 | Spaunhorst | |
| 2007/0159291 | A1 * | 7/2007 | Wilniewczyc | H01H 85/042 337/159 |
| 2008/0191832 | A1 | 8/2008 | Tsai | |
| 2009/0027821 | A1 * | 1/2009 | Colby | H01C 7/02 361/104 |
| 2009/0261451 | A1 | 10/2009 | Whitney | |
| 2011/0096448 | A1 | 4/2011 | Wortberg | |
| 2014/0240082 | A1 * | 8/2014 | Zheng | H01H 69/02 337/231 |

FOREIGN PATENT DOCUMENTS

| | | | | |
|---|---|---|---|---|
| GB | 674973 | A * | 7/1952 | H01H 85/055 |
| JP | WO 2015012193 | A1 * | 1/2015 | H02H 9/026 |

* cited by examiner

ELECTRICAL CIRCUIT PROTECTION DEVICE WITH HIGH RESISTIVE BYPASS MATERIAL

FIELD OF THE DISCLOSURE

The disclosure relates generally to the field of fuses (e.g., electrical circuit protection devices) for protection against overcurrent conditions and more particularly to a fuse, such as, for example, a surface-mountable electrical circuit protective device having a high resistive material in parallel with a fusible element.

BACKGROUND OF THE DISCLOSURE

Fuses, which are commonly used as electrical circuit protection devices, provide electrical connections between sources of electrical power and circuit components that are to be protected. Upon the occurrence of a specified fault condition in a circuit, such as an overcurrent condition, a fusible element can melt, or otherwise separate, to interrupt current flow in the circuit path. Protected portions of the circuit are thereby electrically isolated and damage to such portions may be prevented or at least mitigated.

One known issue with existing fuses is that the current may arc across the fusible element during a clearing time, which may result in additional damage to the downstream circuit components. In addition, such arcing prevents fuses from obtaining significantly higher safety ratings.

Thus, a need exists for an improved fuse that prevents or minimizes arcing. It is with respect to these and other considerations that the present improvements have been needed.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Various embodiments are generally directed to a fuse that utilizes both a fusible element and a high-resistive material disposed in layers of a chip fuse.

In accordance with the present disclosure, a fuse is disclosed that includes a fusible element having a first electrical resistance, and a high-resistive material having a second electrical resistance where the high-resistive material is in a parallel relationship with the fusible element. During a normal operating condition, the first electrical resistance is less than the second electrical resistance such that current flows through the fusible element. During an overcurrent condition, the first electrical resistance is greater than the second electrical resistance such that current flows through the high-resistive material. As mentioned, the fuse may be in the form of a chip fuse having a plurality of non-conductive layers wherein the fusible element is disposed between adjacent layers of the plurality of non-conductive layers and the high-resistive material is also disposed between adjacent layers of the plurality of non-conductive layers such that at least one of the plurality of non-conductive layers is disposed between the fusible element and the high-resistive material. A substrate upon which the fusible element, high-resistive material and plurality of non-conductive layers are disposed is also included in the chip fuse configuration.

BRIEF DESCRIPTION OF THE DRAWINGS

By way of example, specific embodiments of the disclosed device will now be described, with reference to the accompanying drawings, in which.

DETAILED DESCRIPTION

Figure 1:
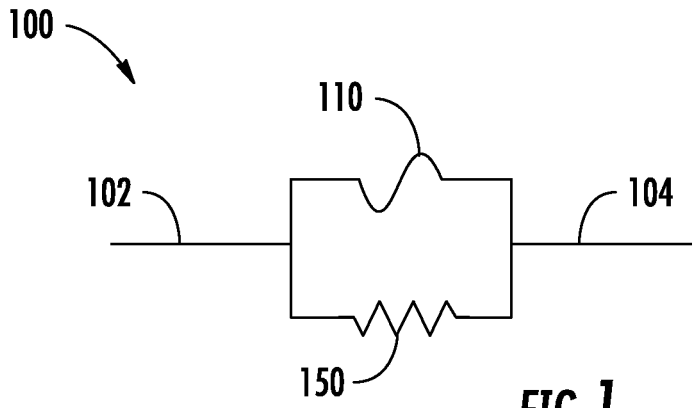
FIG. 1 is a schematic illustration of an exemplary embodiment of a fuse according to the present disclosure.

The present disclosure will now be described more fully hereinafter with reference to the accompanying drawings, in which preferred embodiments are shown. This disclosure, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

Referring to FIG. 1, according to one aspect of the present disclosure, a fuse or an electrical circuit protection device (collectively referred to herein as a fuse without the intent to limit) 100 is disclosed. As shown, the fuse 100 may include an input 102, an output 104, a fusible element 110, and a high-resistive element or material 150 (collectively referred to herein as a high-resistive material without the intent to limit). In use, the fuse 100 includes a high-resistive material 150 placed in a parallel relation relationship with a fusible element 110 to mitigate, minimize and/or prevent arcing during an overcurrent condition. That is, by placing a high-resistive material 150 in parallel with a fusible element 110, an arc quenching system is created wherein the electrical current is provided with an alternate, second path to flow during an overcurrent condition (e.g., during a fuse opening event) thus facilitating an arc-less operation as the electrical circuit is being de-energized. In one embodiment, the high-resistive material 150 may be as high as 200 kΩ at room temperature. Alternatively, the high-resistive material 150 may have values in the range of, for example, 0.2 kΩ-200 kΩ and is dependent on the particular application.

As previously mentioned, during an overcurrent condition, the fusible element 110 may be exposed to higher currents including currents exceeding normal operating ranges. As such, the fusible element 110 may melt, or otherwise separate, to interrupt current flow in the circuit path to thereby electrically isolate and protect downstream portions of the circuit. However, during the clearing time, the current may arc across the melted or separated fusible element 110. Generally, the clearing time refers to the total amount of open time of the fuse, or the time from the occurrence of an electrical overstress (EOS) to the time the fuse prevents current flow. The clearing time may include the total amount of time for the fusible element to melt and/or separate, plus the amount of time arcing occurs. The arc continues until the gap created by the fusible element melting or separating is large enough to prevent the arc.

As will be appreciated by one of ordinary skill in the art, in a DC circuit, current travels through the path of least resistance. As such, during normal operating conditions, current travels through the fusible element 110 with the high-resistive material 150 having no affect. This is because, during normal operating conditions, the fusible element 110 has a first electrical resistance that is less than a second electrical resistance of the high-resistive material 150. However, during an overcurrent condition, the resistance through the fusible element 110 increases. Once the resistance through the fusible element 110 is greater than the resistance through the high-resistive material 150 (e.g., once the second electrical resistance of the high-resistive material is less than the first electrical resistance of the fusible element), the current will bypass the fusible element 110 and travel through the high-resistive material 150. In this manner, by properly selecting and designing the high-resistive material 150, arcing through the fusible element 110 during an overcurrent condition can be prevented or minimized.

As will be described in greater detail below, the fuse 100 including the fusible element 110 and the high-resistive material 150 may be incorporated into a single housing, body or enclosure. Alternatively, the fusible element 110 and the high-resistive material 150 may be separate and distinct from one another. In any event, the fusible element 110 and the high-resistive material 150 may be arranged in a parallel relationship with each other so that in a first, normal operating condition, current flows through the fusible element 110, while in a second, overcurrent condition, current bypasses the fusible element 110 and travels through the high-resistive material 150.

In addition, as will be described in greater detail below, the present invention will be described and illustrated in conjunction with a chip fuse, also known as a thin-film fuse, a surface-mount fuse, or SMD fuses. Chip fuses are often used to provide protection to components on a printed circuit board (not shown). It should be appreciated however that any fuse arranged and configured to provide electrical protection between sources of electrical power and circuit components that are to be protected may be used.

Figure 2:
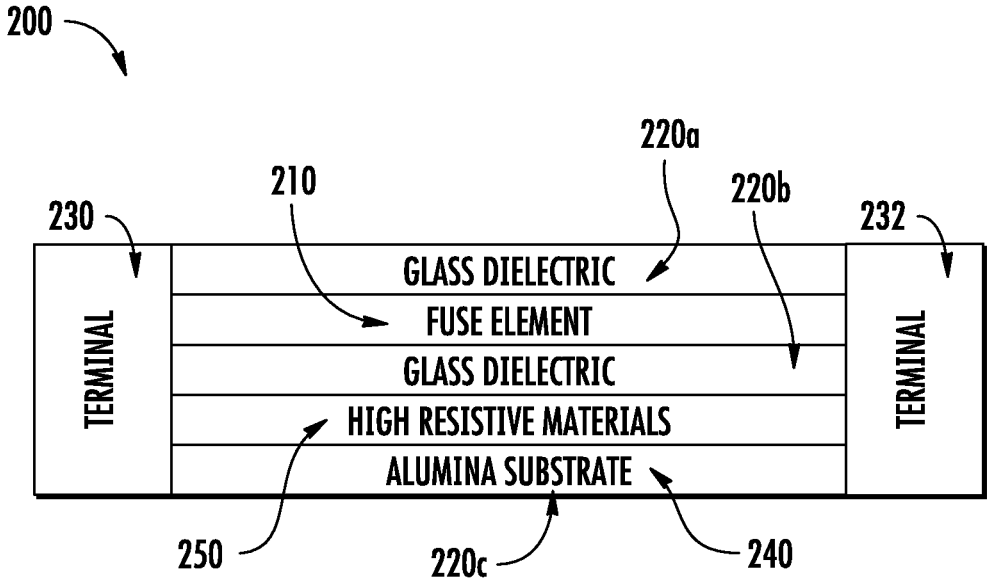
FIG. 2 is a side view illustrating an exemplary embodiment of a chip fuse according to the present disclosure.
Figure 3:
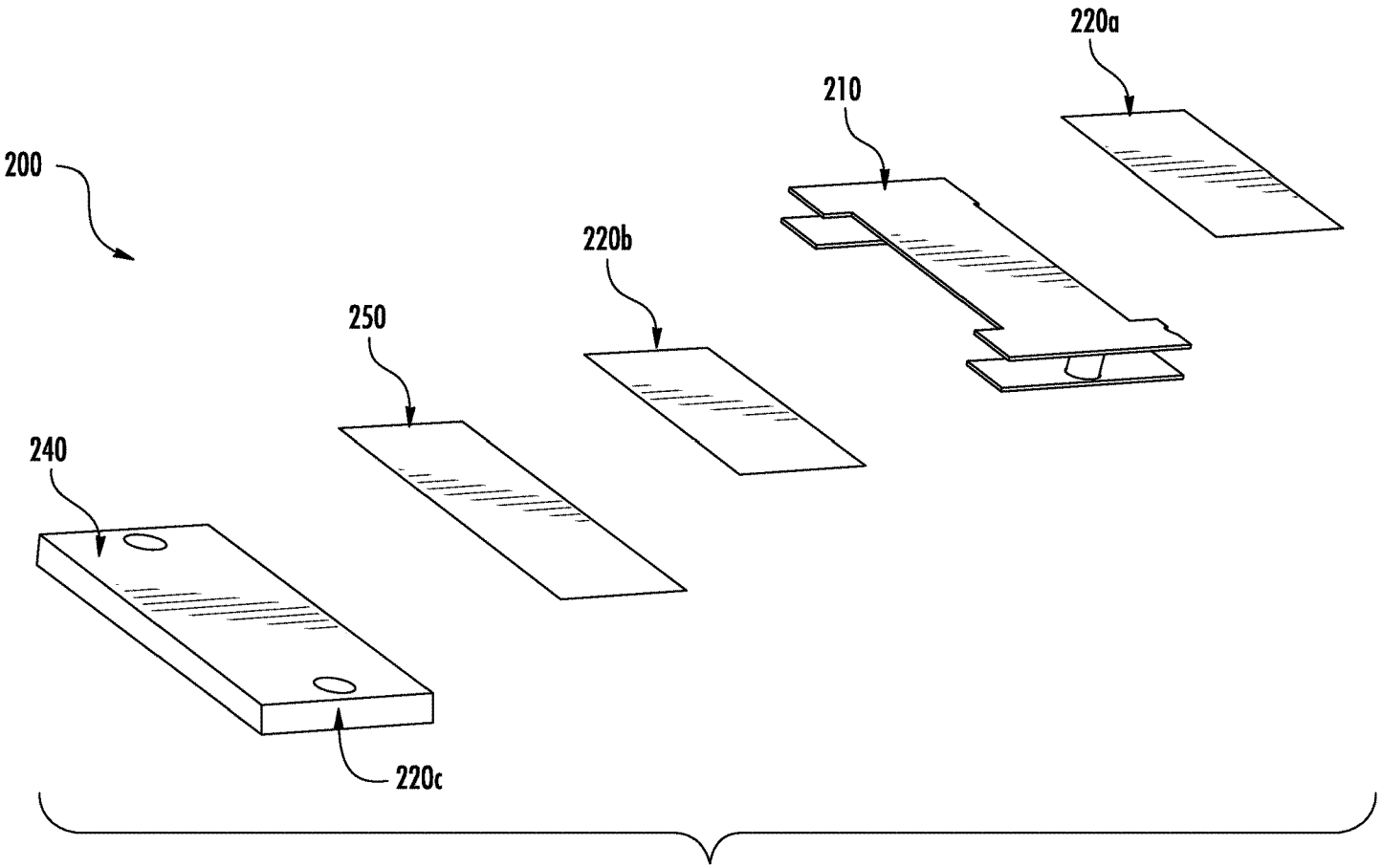
FIG. 3 is an exploded perspective view of the chip fuse shown in FIG. 2.

Referring to FIGS. 2 and 3, an illustrative, exemplary embodiment of a fuse 200 according to the present invention is illustrated. As shown, the fuse 200 is in the form of a chip fuse and includes a fusible element 210 disposed between non-conductive layers of material 220 (shown as first and second non-conductive layers 220*a*, 220*b*). Upon the occurrence of a specified fault condition in a circuit, such as an overcurrent condition, the fusible element 210 can melt, or otherwise separate, to interrupt current flow in the circuit path (e.g., between the input and output) in order to electrically isolate and protect downstream portions of the circuit.

The fuse 200 may also include first and second conductive terminals 230, 232. The first and second conductive terminals 230, 232 may be connected to each end of the fusible element 210 to provide a means of connecting the fuse 200 within the circuit. That is, the fusible element 210 may extend horizontally across the non-conductive layers of material 220 to contact each of the first and second conductive terminals 230, 232. The fusible element 210 contacts the first and second conductive terminals 230, 232 to form an electrical connection through the fuse 200. In use, the first and second conductive terminals 230, 232 connect the fuse 200 to the print circuit board.

The fusible element 210 may be any material having desirable electrically conductive properties. For example, the fusible element 210 may be any now known or hereafter developed conductive material such as nickel, copper, tin, silver, or an alloy or mixture comprising nickel, copper, silver, gold, or tin. The fusible element 210 may be formed of one or more layers of electrically conductive material. The fusible element 210 may be selected to have a desired diameter, width, and configuration to provide a predetermined response to current and voltage. Alternatively, the fusible element 210 may be a deposited film or other suitable material having predetermined characteristics. In some examples, the fusible element 210 may have a thickness between 0.02 and 5 mils.

The non-conductive layers 220 may be any material having desirable electrically non-conductive properties. For example, the non-conductive layers 220 may be any now known or hereafter developed non-conductive material such as ceramic (e.g., alumina), a ceramic-glass compound, a low temperature co-fired ceramic (LTCC) material, combination of such materials, etc. The non-conductive layers 220 may be formed of one or more layers of electrically non-conductive material. In some examples, the non-conductive layers 220 may have a thickness between 0.5 and 20 mils.

The first and second conductive terminals 230, 232 may be any material having desirable electrically conductive properties. For example, the first and second conductive terminals 230, 232 may be any now known or hereafter developed conductive material such as silver, copper, tin, nickel, or any combination of such materials.

The fuse 200 may also include a high-resistive material 250. The high-resistive material 250 may be disposed between non-conductive layers of material 220. For example, the high-resistive material 250 may be disposed between the second non-conductive layer of material 220*b* and a third non-conductive layer of material 220*c*.

Alternatively, as shown, the fuse 100 may also include a substrate 240. In use, the substrate 240 may be a non-conductive layer of material 220. As such, the substrate 240 may take the place of one of the non-conductive layers of material 220 (e.g., shown as the third non-conductive layer of material 220*c*). In this manner, as shown, the high-resistive material 250 may be disposed between the second layer of non-conductive material 220*b* and the layer of substrate 240.

In use, the substrate 240 provides support to the fuse 200 and ensures that when the fusible element 210 melts in response to a fault condition, the fuse 200 does not rupture as rupturing of the fuse 200 can cause damage to the components to be protected as well as adjacent components on the printed circuit board. The substrate 240 may be any rigid substrate now known or hereafter developed. For example, the substrate 240 may be an Alumina substrate, FR4, etc. The substrate 240 may be printed with identifying information that can be visible to consumers. As shown, the substrate 240 may be located at the bottom of the fuse 200. However, it should be appreciated that the substrate 240 may be vertically located anywhere within the fuse 200.

In use, the high-resistive material 250 provides greater resistance to current flow than the fusible element 210. In this manner, during normal operating conditions, the high-resistive material 250 sits dormant (i.e., the high-resistive material 250 does not affect or alter current flow through the fuse 200). That is, as will be appreciated by of ordinary skill in the art, in an electrical DC circuit, current takes the path of least resistance. The fusible element 210 may have a first electrical resistance while the high-resistive material 250 may have a second electrical resistance, which is greater than the first electrical resistance through the fusible element 210. As such, during normal operating conditions, the current flows through the fusible element 210. During an over-current situation, however, as the fusible element 210 melts and/or separates, the resistance through the fusible element 210 increases. Once the resistance through the fusible element 210 exceeds the resistance through the high-resistive material 250, the current travels through the high-resistive material 250 thereby preventing or minimizing arcing across the fusible element 210.

The high-resistive material 250 may be any now known or hereafter developed material including, but not limited to, Polymeric Thermo confident polymer, think film resistor, wire wound resistors, etc.

Figure 4:
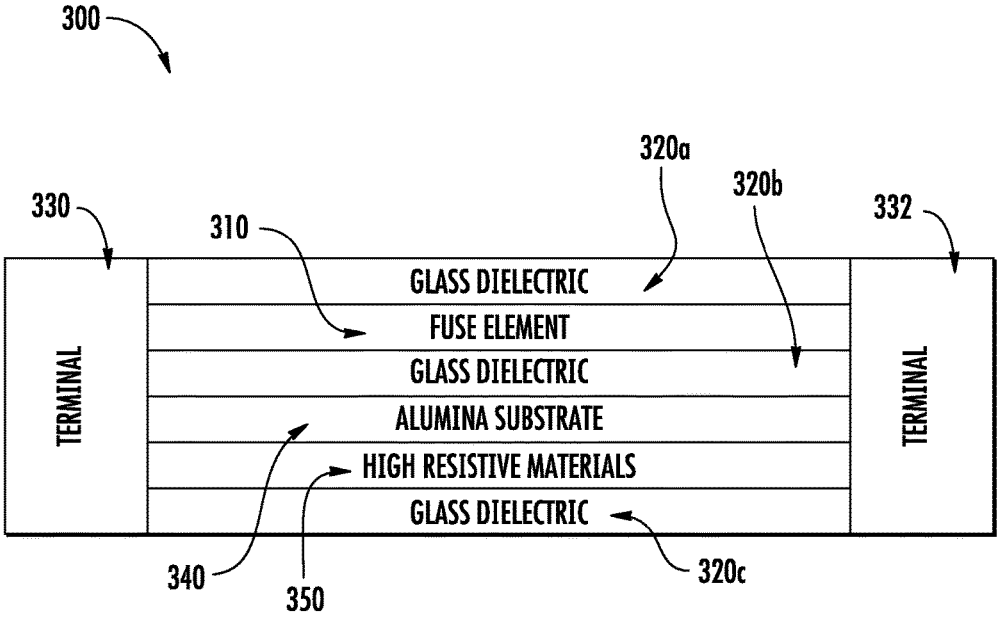
FIG. 4 is a side view illustrating an alternate, exemplary embodiment of a chip fuse according to the present disclosure.
Figure 5:
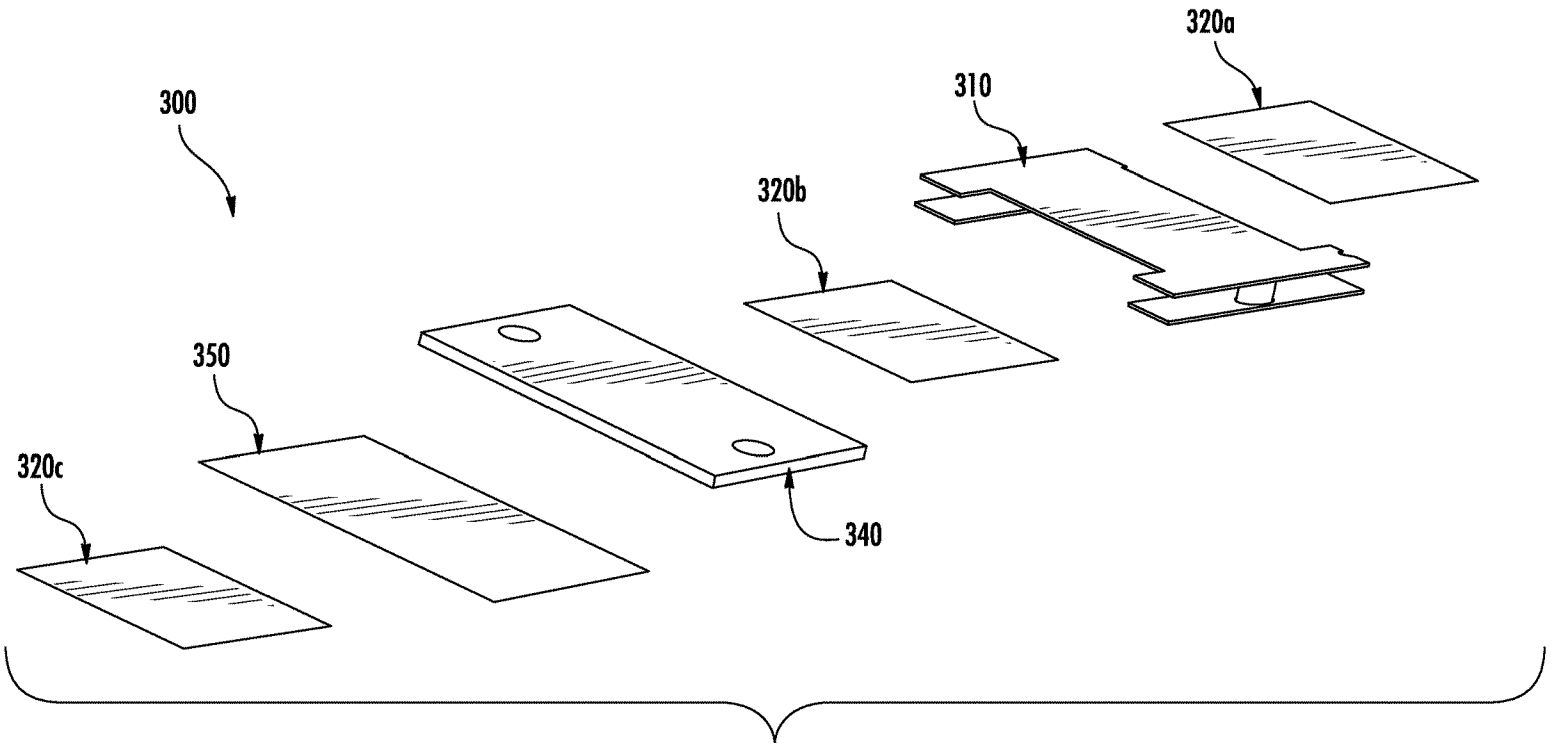
FIG. 5 is an exploded perspective view of the chip fuse shown in FIG. 4.

Referring to FIGS. 4 and 5, an alternate illustrative, exemplary embodiment of a fuse 300 according to the present invention is illustrated. The fuse 300 illustrated in FIGS. 4 and 5 is substantially similar to the fuse 200 illustrated in FIGS. 2 and 3. As such, some of the disclosure is hereby omitted for the sake of brevity.

As shown, the fuse 300 is in the form of a chip fuse and includes a fusible element 310 disposed between non-conductive layers of material 320 (shown as first and second non-conductive layers 320*a*, 320*b*). Upon the occurrence of a specified fault condition in the circuit, such as an over-current condition, the fusible element 310 can melt, or otherwise separate, to interrupt current flow in the circuit path (e.g., between the input and output) in order to electrically isolate and protect downstream portions of the circuit.

The fuse 300 may also include first and second conductive terminals 330, 332. The first and second conductive terminals 330, 332 may be connected to each end of the fusible element 310 to provide a means of connecting the fuse 300 within the circuit. That is, the fusible element 310 may extend horizontally across the non-conductive layers of material 320 to contact each of the first and second conductive terminals 330, 332. The fusible element 310 contacts the first and second conductive terminals 330, 332 to form an electrical connection through the fuse 300. In use, the first and second conductive terminals 330, 332 connect the fuse 300 to the print circuit board.

The fuse 300 may also include a high-resistive material 350. The high-resistive material 350 may be disposed between non-conductive layers of material 320. Alternatively, as shown, the fuse 300 may also include a substrate 340. In use, the substrate 340 may be a non-conductive layer of material 320. As such, the substrate 340 may take the place of one of the non-conductive layer of material 320. In this manner, as shown, the high-resistive material 350 may be disposed between the layer of substrate 340 and a third layer of non-conductive material 320*c*.

Thus, as shown, the primary difference between fuse 200 (shown and described in connection with FIGS. 2 and 3) and fuse 300 (shown and described in connection with FIGS. 4 and 5) is the location of the layer of substrate. In connection with fuse 300, the layer of substrate 340 is located more in the middle of the fuse 300 as compared to fuse 200 where the layer of substrate 240 was located at the bottom of the fuse 200. In addition, by locating the layer of substrate 340 more in the middle, above the layer of high-resistive material 350, the fuse 300 includes an additional layer of non-conductive material 320*c*.

In use, the substrate 340 provides support to the fuse 300 and ensures that when the fusible element 310 melts in response to a fault condition, the fuse 300 does not rupture as rupturing of the fuse 300 can cause damage to the components to be protected as well as adjacent components on the printed circuit board. The substrate 340 may be printed with identifying information that can be visible to consumers.

In use, the high-resistive material 350 provides greater resistance to current flow than the fusible element 310. In this manner, during normal operating conditions, the high-resistive material 350 sits dormant (i.e., the high-resistive material 350 does not affect or alter current flow through the fuse 300). That is, as will be appreciated by of ordinary skill in the art, in an electrical DC circuit, current takes the path of least resistance. The fusible element 310 may have a first electrical resistance while the high-resistive material 350 may have a second electrical resistance, which is greater than the first electrical resistance through the fusible element 310. As such, during normal operating conditions, the current flows through the fusible element 310. During an over-current situation, however, as the fusible element 310 melts and/or separates, the resistance through the fusible element 310 increases. Once the resistance through the fusible element 310 exceeds the resistance through the high-resistive material 350, the current travels through the high-resistive material 350 thereby preventing or minimizing arcing across the fusible element 310.

It is to be appreciated, that the number and arrangement of layers depicted in FIGS. 2-5 is done to facilitate understanding and is not intended to be limiting. More specifically, for example, various embodiments may include more or less nonconductive layers 220, 320 than depicted. Furthermore, as will be appreciated, it may not be possible to distinguish between the non-conductive layers 220, 320 in the manufactured device.

Figure 6:
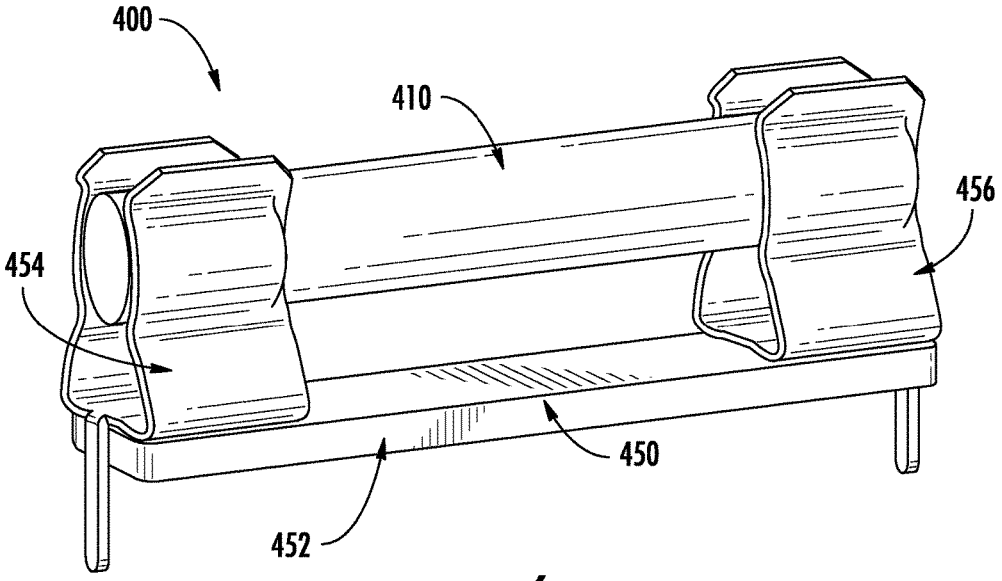
FIG. 6 is a perspective view illustrating an alternate, exemplary embodiment of a fuse according to the present disclosure.

Referring to FIG. 6, a perspective view of an alternate illustrative, exemplary embodiment of a fuse 400 according to the present invention is illustrated. The fuse 400 illustrated in FIG. 6 is substantially similar to fuse 200 (FIGS. 2 and 3) and fuse 300 (FIGS. 4 and 5). As such, some of the disclosure is hereby omitted for the sake of brevity.

As shown however, the primary difference between fuse 400 (shown and described in connection with FIG. 6) and fuses 200, 300 (shown and described in connection with FIGS. 2-5) is that fuse 400 is no longer in the form of a chip fuse. As shown, for example, the fusible element 410 may be in the form of a standard glass fuse, although other fuses are contemplated. In use, the glass fuse 410 may be coupled to a fuse holder 450. That is, a fuse holder 450 may be provided. The fuse holder 450 including a body portion 452 and contacts 454, 456. In use, the contacts 454, 456 may couple and engage the ends of the glass fuse 410 as would be readily appreciated by one of ordinary skill in the art. In accordance with the principles of the present disclosure, the body portion 452 of the fuse holder 450 may be manufactured from a high-resistive material so that, in use, upon the occurrence of a specified fault condition in the circuit, such as an overcurrent condition, the fusible element (e.g., glass fuse) 410 can melt, or otherwise separate, to interrupt current flow in the circuit path (e.g., between the input and output) in order to electrically isolate and protect downstream portions of the circuit. However, by forming the body portion 452 of the fuse holder 450 from a high-resistive material, during an over-current situation, as the fusible element (e.g., glass fuse) 410 melts and/or separates, the resistance through the fusible element (e.g., glass fuse) 410 increases. Once the resistance through the fusible element (e.g., glass fuse) 410 exceeds the resistance through the body portion 452 of the fuse holder 450 made from the high-resistive material, the current travels through the high-resistive fuse holder 450 thereby preventing or minimizing arcing across the fusible element (e.g., glass fuse) 410.

Thus, in accordance with the principles of the present disclosure, the fusible element (e.g., glass fuse) 410 may have a first electrical resistance while the body portion 452 of the fuse holder 450 manufactured from a high-resistive material may have a second electrical resistance, which is greater than the first electrical resistance through the fusible element (e.g., glass fuse) 410. In normal operating condition, the high-resistive fuse holder 450 provides greater resistance to current flow than the fusible element (e.g., glass fuse) 410. Thus, during normal operating conditions, the high-resistive fuse holder 450 sits dormant (i.e., the high-resistive fuse holder 450 does not affect or alter current flow through the fuse 400). But, during an overcurrent situation, as the fusible element (e.g., glass fuse) 410 melts and/or separates, the resistance through the fusible element (e.g., glass fuse) 410 surpasses the resistance through the high-resistive fuse holder 450 so that the current travels through the high-resistive fuse holder 450 thereby preventing or minimizing arcing across the fusible element (e.g., glass fuse) 410.

Figure 7:
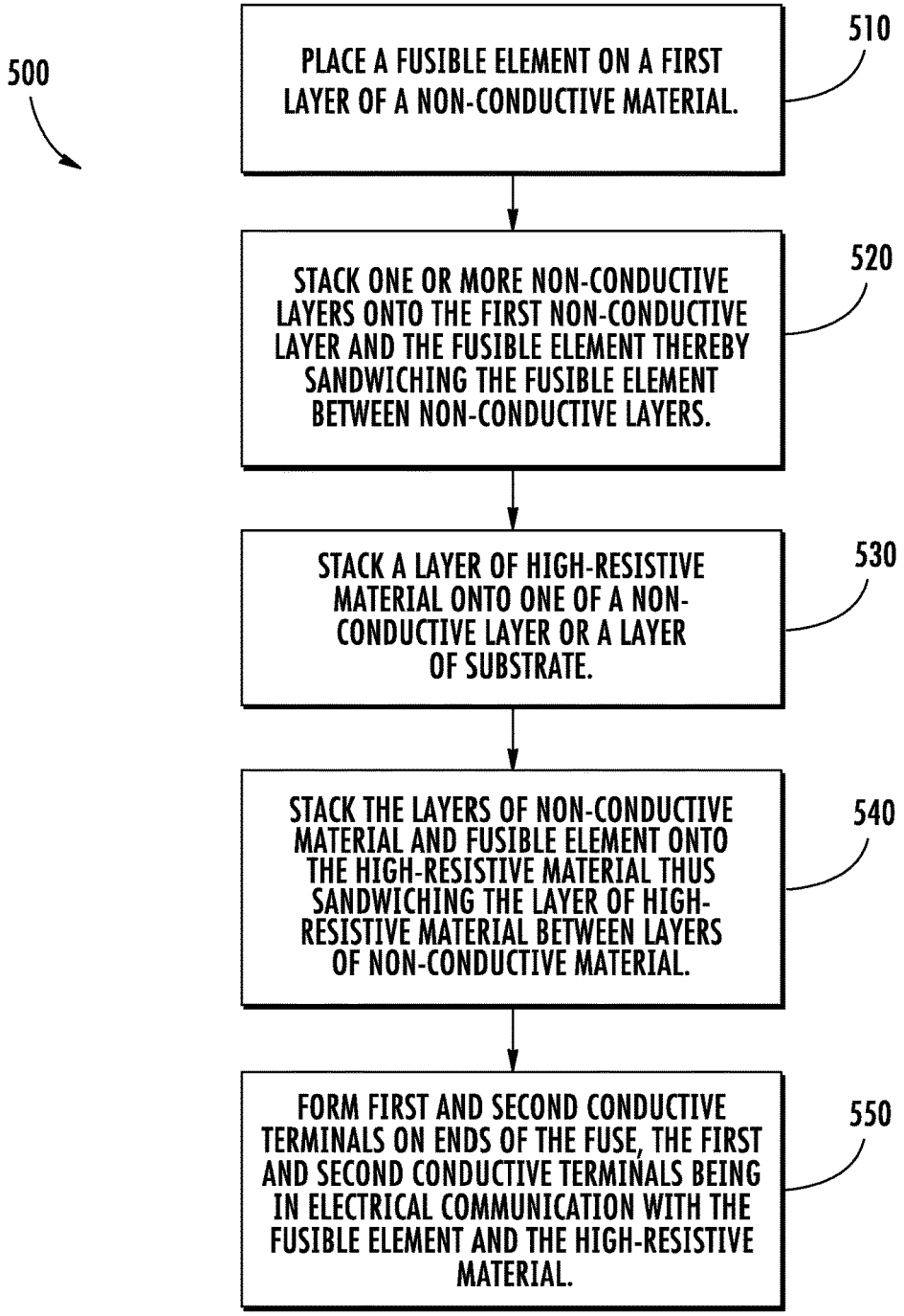
FIG. 7 is a flow diagram of a method for manufacturing a chip fuse, all arranged in accordance with at least some embodiments of the present disclosure.

FIG. 7 is a flow diagram of a method 500 for manufacturing a fuse according to some embodiments of the present disclosure. The method 500 may begin at block 510. At block 510, a fusible element may be placed on a layer of a non-conductive material. For example, the fusible element 210 may be placed on non-conductive layer 220*b*.

Continuing to block 520, one or more non-conductive layers may be stacked onto the first non-conductive layer and the fusible element thus sandwiching the fusible element between non-conductive layers. For example, non-conductive layer 220*a* may be stacked onto fusible element 210 and non-conductive layer 220*b*.

Continuing to block 530, a high-resistive material may be stacked onto a non-conductive layer. Alternatively, if the chip fuse is going to include a substrate, the high-resistive material may be stacked onto the substrate. For example, a layer of high-resistive material 250 may be stacked onto a layer of non-conductive material 220*c*, for example, substrate 240.

Continuing to block 540, the layers of non-conductive material and fusible element may be stacked onto the high-resistive material thus sandwiching the layer of high-resistive material between layers of non-conductive material. For example, non-conductive layer 220*b* may be stacked onto the layer of high-resistive material 250.

Continuing to block 550, first and second fuse terminals may be formed on the fuse. For example, the first and second conductive terminals 230, 232 may be formed on the fuse 200. In some examples, the materials may be formed by dipping and/or plating the ends of the fuse.

It is to be appreciated, that the number and arrangement of layers described in connection with FIG. 7 is done to facilitate understanding and is not intended to be limiting. For example, the chip fuse may include more or less layers. In addition, and/or alternatively, the chip fuse may be manufactured in different steps. As an example, a layer of non-conductive material or a layer of substrate may be placed first. Next, a layer of high-resistive material may be stacked onto the layer of non-conductive material or the layer of substrate. A layer of non-conductive material may then be stacked on the high-resistive material followed by stacking the fusible element and then another layer of non-conductive material.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are in the tended to fall within the scope of the present disclosure. Furthermore, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Thus, the claims set forth below should be construed in view of the full breadth and spirit of the present disclosure as described herein.

The invention claimed is:

1. A fuse comprising:

a fusible element having a first electrical resistance;

a high-resistive material having a second electrical resistance, the high-resistive material being in a parallel relationship with the fusible element;

a first conductive terminal at a first end of the chip fuse and a second conductive terminal disposed at a second end of the chip fuse, the first and second conductive terminals electrically connected to the fusible element and the high-resistive material; and a plurality of non-conductive layers wherein the fusible element is disposed between adjacent layers of the plurality of non-conductive layers that are in direct and continuous mechanical contact with the fusible element between the first conductive terminal and the second conductive terminal, and the high-resistive material is disposed between adjacent layers of the plurality of non-conductive layers that are in direct and continuous mechanical contact with the high-resistive material between the first conductive terminal and the second conductive terminal;

wherein during a normal operating condition the first electrical resistance is less than the second electrical resistance such that current flows through the fusible element; and wherein during an overcurrent condition the first electrical resistance is greater than the second electrical resistance such that current flows through the high-resistive material.

2. The fuse of claim 1, wherein one of the plurality of non-conductive layers comprises a substrate upon which the fusible element, high-resistive material and plurality of non-conductive layers are disposed.

3. The fuse of claim 2, wherein the substrate is FR4.

4. The fuse of claim 1, wherein the plurality of non-conductive layers includes first, second and third layers of non-conductive material, the fusible element being disposed between the first and second layers of non-conductive material, the high-resistive material being disposed between the second and third layers of non-conductive material.

5. The fuse of claim 4, wherein the third layer of non-conductive material comprises a substrate for supporting the fuse.

6. The fuse of claim 1, wherein the plurality of non-conductive layers includes first, second, third and fourth layers of non-conductive material, the fusible element being disposed between the first and second layers of non-conductive material, the high-resistive material being disposed between the third and fourth layers of non-conductive material.

7. The fuse of claim 6, wherein the third layer of non-conductive material comprises a substrate upon which the fusible element, high-resistive material and non-conductive material are disposed.

8. The fuse of claim 1, wherein the second resistance of the high-resistive material is up to approximately 200 kohms at room temperature.

* * * * *